US006994226B2

(12) United States Patent
Shuert

(10) Patent No.: US 6,994,226 B2
(45) Date of Patent: Feb. 7, 2006

(54) REINFORCING CLIP FOR A CORRUGATED SLEEVE

(76) Inventor: Lyle H. Shuert, 70 Kingsley Manor Dr., Bloomfield Hills, MI (US) 48304

( * ) Notice: Subject to any disclaimer, the term of this patent is extended or adjusted under 35 U.S.C. 154(b) by 245 days.

(21) Appl. No.: 10/455,592

(22) Filed: Jun. 5, 2003

(65) Prior Publication Data

US 2004/0245248 A1 Dec. 9, 2004

(51) Int. Cl.
*B65D 6/16* (2006.01)

(52) U.S. Cl. ..... 220/4.29; 24/458; 220/4.28; 206/600

(58) Field of Classification Search ..... 220/4.28, 220/4.33, 1.5, 6.22, 4.29; 206/386, 600; 229/198.2, 198.3; 24/458, 519, 499, 564, 24/684

See application file for complete search history.

(56) References Cited

U.S. PATENT DOCUMENTS

| | | | | |
|---|---|---|---|---|
| 2,555,926 A | 6/1951 | Hendrick | 220/73 | |
| 2,893,588 A | 7/1959 | Martin | 220/4 X | |
| 3,568,912 A | 3/1971 | Simas | 206/598 X | |
| 3,664,570 A | 5/1972 | Kupersmit | 108/55.1 X | |
| 3,797,691 A | 3/1974 | Williams, Jr. | 220/1.5 | |
| 3,797,727 A | 3/1974 | Downing et al. | 108/55.1 X | |
| 3,989,157 A | 11/1976 | Veenema | 220/4 F | |
| 4,030,600 A | 6/1977 | Heaps | 206/386 | |
| 4,239,149 A | 12/1980 | Kupersmit | 206/600 V | |
| 4,531,670 A | 7/1985 | Kupersmit | 220/4 F | |
| 4,765,252 A | 8/1988 | Shuert | 108/55.1 | |
| 4,936,451 A | 6/1990 | Shuert | 206/386 | |
| 5,109,985 A * | 5/1992 | Rose | 206/600 | |
| 5,123,541 A * | 6/1992 | Giannini et al. | 206/600 | |
| 5,862,917 A * | 1/1999 | Noble et al. | 206/600 | |

* cited by examiner

*Primary Examiner*—Joseph C. Merek
(74) *Attorney, Agent, or Firm*—Young & Basile, P.C.

(57) ABSTRACT

A plastic reinforcing clip for use with a container of the type including a corrugated sleeve adapted to be removably attached to a plastic pallet or base member by the use of sliding latch members coacting with circular apertures in the lower peripheral edge portion of the sleeve. The reinforcing clip structure is formed of a single piece of molded plastic material and includes an outer annular planar portion, an inner annular planar portion, an outer cup-shaped liner portion, an inner cup-shaped liner portion, and a central hinge portion. In use, the central hinge portion is positioned under and along the lower edge of the sleeve beneath an aperture in the sleeve and the inner and outer planar portions are swung upwardly about live hinges provided between the hinge portion and the inner and outer planar portions. As the inner and outer planar portions are swung upwardly and inwardly, the cup-shaped liner portions enter the slot from the inner and outer faces of the sleeve. A circular annular wall section of the outer liner portion is seated within and engages an outer annular portion of the circular aperture edge with a planar base section of the liner portion positioned centrally within the aperture and a circular annular wall section of the inner liner portion is seated within and engages an inner annular portion of the circular aperture with a planar base section of the inner liner portion abutting the base section of the outer liner portion. The abutting planar base sections are suitably secured together as by stabling to fixedly secure the clip on the sleeve to preclude damage to the sleeve in response to repeated actuation of the latch members.

22 Claims, 4 Drawing Sheets

REINFORCING CLIP FOR A CORRUGATED SLEEVE

BACKGROUND OF THE INVENTION

This application relates to shipping storage containers and more particularly to containers in which the base of the container serves as a reusable pallet.

Various container designs have been employed to ship and store industrial goods. In many instances the containers are stored in large warehouse facilities where they are moved from one location to another by fork-lift trucks or the like. One commonly used container incorporates a corrugated sleeve which is nailed to a conventional wooden pallet. The sleeve forms the side walls of the container and the pallet serves as its bottom. The use of the wooden pallets, however, have some drawbacks. For example, they are subject to breakage and thus are not reusable over an extended period of time. Wooden pallets also take up a considerable amount of valuable floor space in the warehouse when they are not in use.

In an effort to solve some of the problems with the wooden pallets, reusable plastic pallets have been employed with some degree of success. Such pallets have been combined with a corrugated sleeve to form a container. The plastic pallet and sleeve are reusable and may be compactly stacked when not in use, thereby providing significant advantages over conventional wooden pallets.

These composite container designs also have their drawbacks. The edges of the sleeve merely rest in grooves in the pallet in most of the known designs. Consequently, some additional means must be provided to hold them together prior to shipping. For example, the pallet and corrugated sleeve may be banded together by steel bands or cords encircling the components. This banding process introduces an additional expense in both time and money since the container must not only be bound prior to shipping but must also be unbound before the container contents can be removed.

In an effort to eliminate the expense and inconvenience of the banding process, various proposals have been made to facilitate the releasable attachment of the sleeve to the pallet. In one such proposal, as shown for example in applicant's U.S. Pat. Nos. 4,765,252 and 4,856,657, a plurality of latches are slidably mounted on the pallet at circumferentially spaced locations around the periphery of the pallet for coaction with apertures provided at circumferentially spaced locations around the periphery of the sleeve adjacent the lower edge of the sleeve. With this arrangement, the sleeve may be releasably secured to the pallet by resting the lower edge of the sleeve on the pallet with the latches withdrawn inwardly and thereafter sliding the latches outwardly and through the corresponding apertures in the lower edge portion of the sleeve to releasably secure the sleeve to the pallet. Whereas this sliding latch arrangement has proven to be generally satisfactory, the area in and around the apertures in the sleeve, after extended periods of usage, has tended to become damaged with a consequent derogation in the effective operation of the latch mechanism.

SUMMARY OF THE INVENTION

This invention is directed to the provision of an improved container.

More specifically, this invention is directed to the provision of a more durable container of the pallet and sleeve type.

Yet more specifically, this invention is directed to the provision of an improved reinforcing clip for a container of the type including an end unit with sliding latches engaging apertures in a coacting sleeve.

The invention relates to a container of the type including an end unit assembly including an end unit and a plurality of sliding latch members mounted on the end unit at circumferentially spaced locations around the periphery thereof, and a sleeve including an edge adapted to seat on the end unit and including a plurality of apertures adjacent the sleeve edge for locking receipt of the sliding latch members. According to the invention, the container further includes a plurality of reinforcing clips for respective coaction with the apertures in the sleeve and each including an outer planar portion adapted to be positioned against the outer face of the sleeve adjacent the aperture; an inner annular planar portion adapted to be positioned against an inner face of the sleeve adjacent the aperture; a central hinge portion interconnecting the inner and out planar portions and adapted the seat against the edge of the sleeve; an outer cup-shaped liner portion positioned within and projecting inwardly from the outer planar portion and sized the seat within the aperture with an annular wall section of the outer liner portion engaging an outer annular portion of the aperture edge and a planar base section of the liner portion positioned centrally within the aperture; and an inner cup-shaped liner portion positioned within and projecting outwardly from the inner planar portion and sized to seat within the aperture with an annular wall section of the inner liner portion engaging in inner annular portion of the aperture and a planar base section of the inner liner portion abutting against the base section of the inner liner portion. This clip construction is simple and inexpensive, is readily applied to the sleeve, and provides excellent protection to the area in and around the aperture even over extended periods of usage.

According to a further feature of the invention, the aperture has an arcuate configuration and the annular wall sections of the inner and outer liner portions are configured to match the arcuate configuration of the aperture. This specific construction eliminates the stress concentrations inherent in an angular aperture engaged by an angular clip wall section with consequent maximization of sleeve life.

According to a further feature of the invention, the aperture has a circular configuration and the annular wall sections of the inner and outer liner portions have a circular configuration matching the circular configuration of the aperture. This specific arrangement eliminates corner stresses and maximizes the interface area between the clip and the sleeve aperture.

According a further feature of the invention, the base section of the inner liner portion has a rectangular slot for receipt of a sliding latch carried by the end unit. This slot pilots the free end of the latch member and facilitates the movement of the latch member through the reinforcing clip.

According to a further feature of the invention, the base section of the outer liner portion includes a diecut flap covering the slot in the base section of the inner liner portion and sized to be pivoted outwardly in response to outward sliding movement of the latch through the slot in the inner liner portion. This arrangement discourages the entry of contaminants into the interior of the container through the sleeve aperture and further serves to pilot and guide the leading end of the latch member as the latch member moves outwardly.

According to a further feature of the invention, the clip further includes fastening means for maintaining the base sections of the inner and outer liner portions in abutting relation. In the preferred embodiment of the invention, the fastener means comprises staples.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
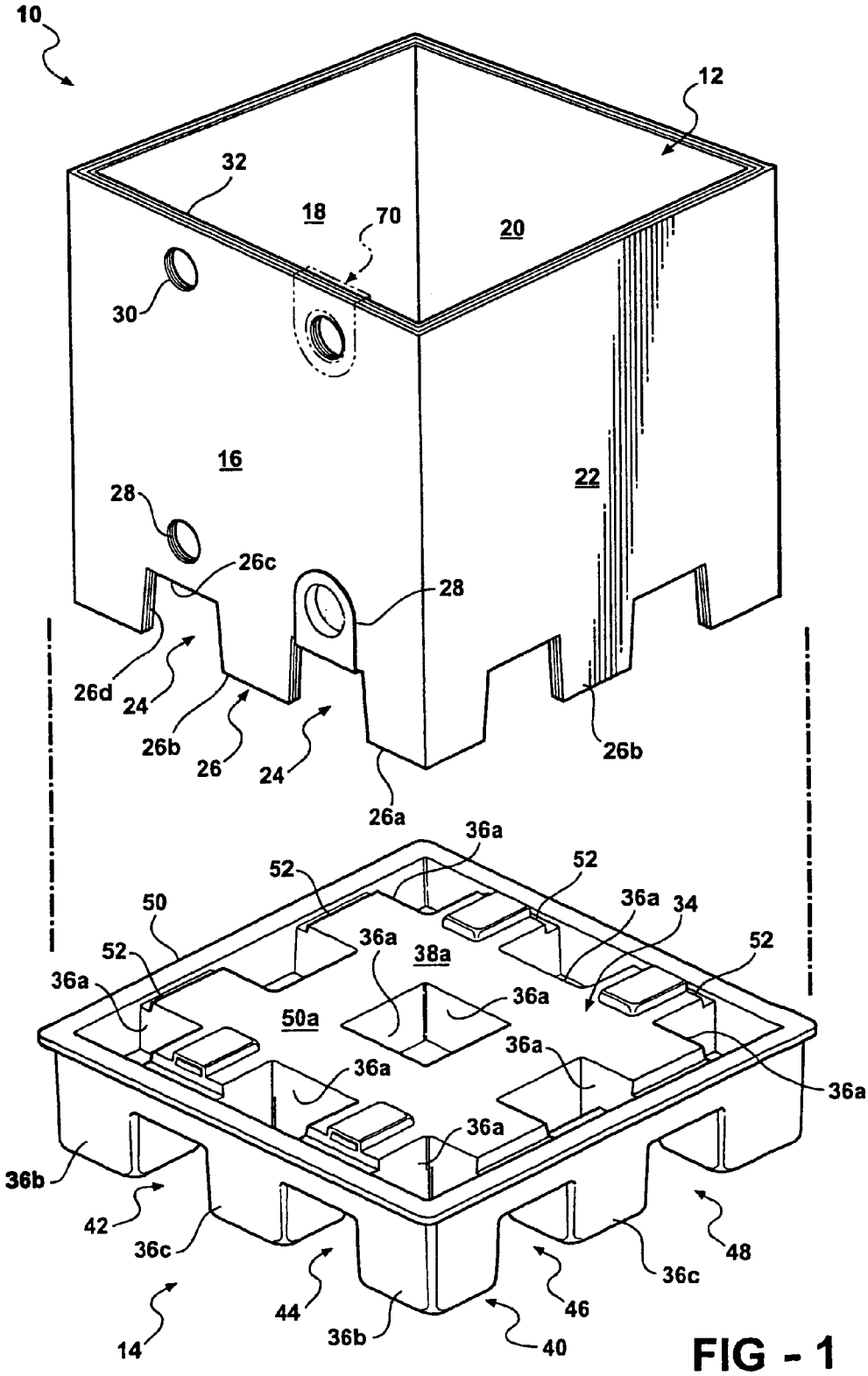
FIG. 1 is an exploded view of a container including a sleeve and a base member including sliding latches for releasably securing the sleeve to the base member.
Figure 2:
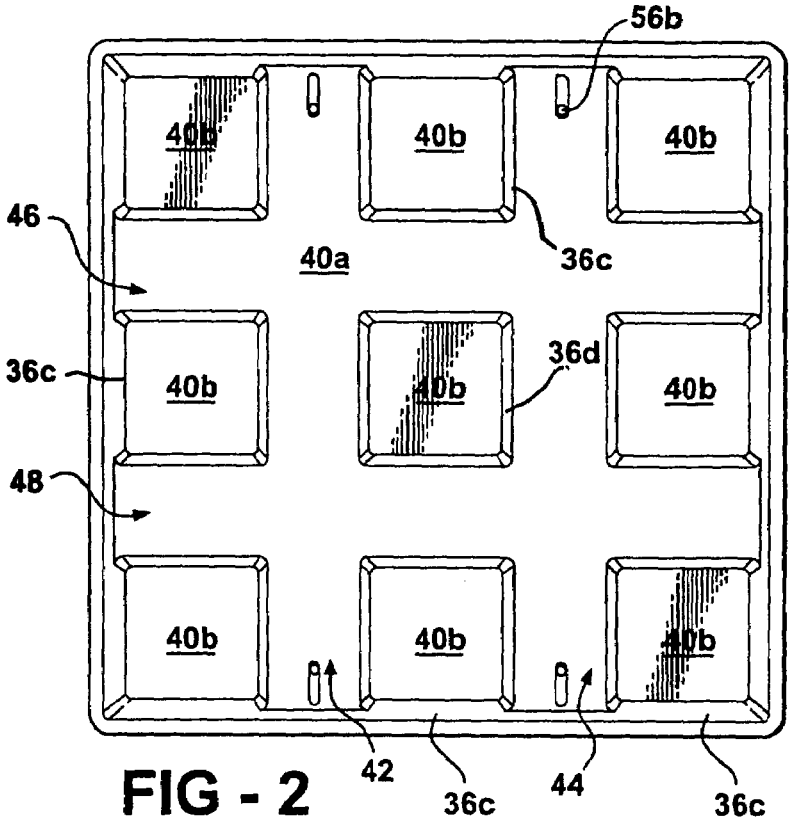
FIG. 2 is a bottom view of the base member of FIG. 1.
Figure 3:
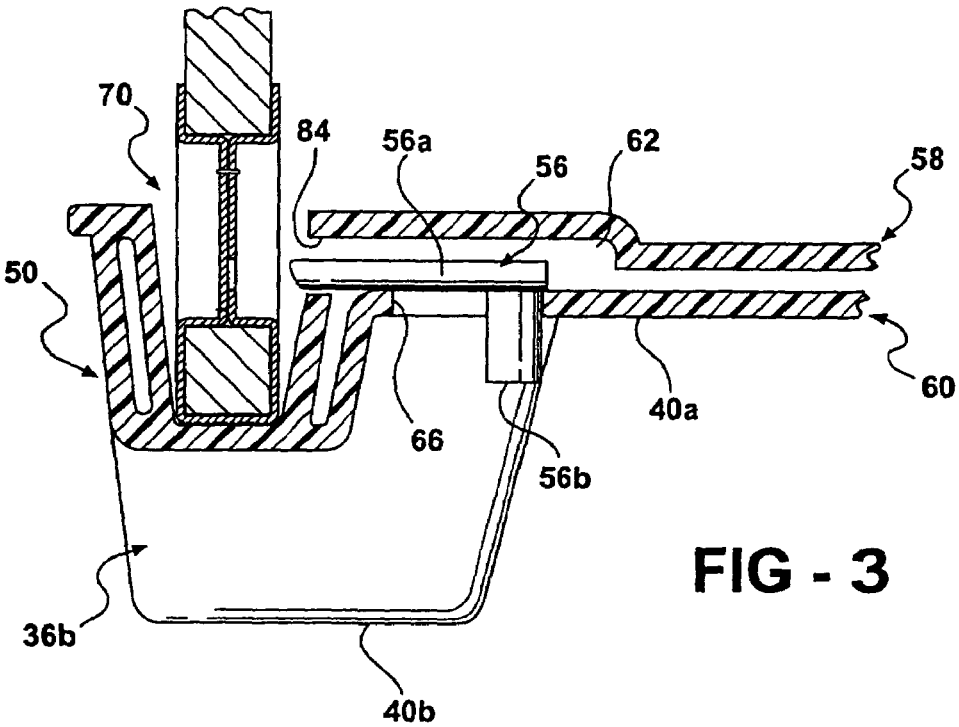
FIG. 3 is a cross-sectional view taken on line 3—3 of FIG. 1 and further showing a reinforcing clip structure according to the invention.
Figure 4:
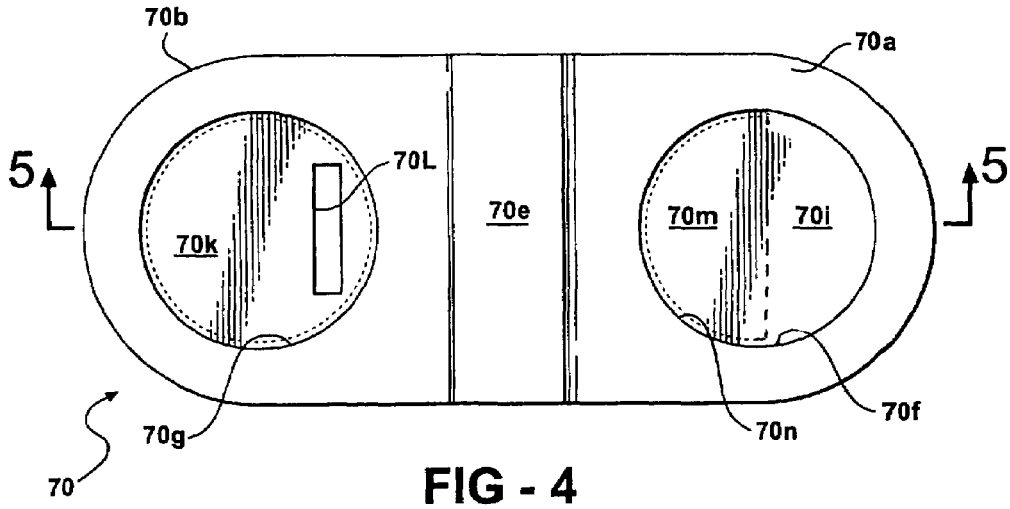
FIG. 4 is a plan view of the invention reinforcing clip structure.

The container seen generally at 10 in FIG. 1 in exploded form includes a sleeve 12 and an end unit in the form of a base or pallet 14. The container may further include another end unit in the form of a top member (not shown) adapted to be fitted over the top of sleeve 12 and having a construction generally similar to the pallet or base member 14.

Sleeve 12 is in the form of an open ended rectangular box providing side walls 16, 18, 20 and 22 for the container. Sleeve 12 is preferably formed of three-ply panels of corrugated material such as commercially available from Triwall Containers Inc. Corrugated material for sleeve 12 is preferred because it is relatively inexpensive, is easy to form, can be collapsed when not in use, and exhibits comparatively good strength characteristics. However, it should be understood that various other suitable materials may be used for sleeve 12.

A pair of truncated pyramidal cut-outs 24 are defined in the bottom edge 26 of the sleeve along each sidewall of the sleeve so that bottom edge 26 is constituted by corner portions 26*a*, immediate portions 26*b*, inset portions 26*c*, and angled portions 26*d*. A through circular aperture 28 is provided immediately above and centrally of the bottom edge insert portions 26*c* in sleeve sidewalls 16 and 20 and similar through circular apertures 30 are provided at circumferentially spaced locations along and below the top edge 32 of sidewalls 16 and 20 of the sleeve for coaction with sliding latch members on the top member (not shown).

Base member 14 is preferably formed in a vacuum forming process and is preferably of a plastic twin sheet construction employing two polyethylene skins which are fused or knitted together at various points to aid in structural rigidity. However, it should be noted that various plastic materials and other formation techniques such as injection molding, rotocasting and the like may be alternately employed.

Base member 14 is generally planar and includes a platform structure 34 and a plurality of hollow legs 36 extending downwardly from platform structure 34 and opening at their upper ends 36*a* in the upper face 38 of the platform structure. The lower or under face 40 of the base member includes a main body portion 40*a* constituting the underface of the platform structure 34 and a base member support surface 40*b* constituted by the lower faces of the bottom walls of the legs 36. Nine legs 36 are provided, including four corner legs 36*b*, four intermediate legs 36*c* and a central leg 36*d*. The legs 36 coact to define a plurality of elongated tunnels or indentations 42, 44, 46 and 48 extending transversely and longitudinally across the underside of the base member. Indentations 42, 44, 46 and 48 provide relieved access areas for receiving the forks of a fork-lift truck or the like. As a consequence, the base member 14 may serve as a pallet for the container 10 which may thus be lifted and moved by conventional warehousing equipment.

The upper face 38 of the base member includes a main body portion 38*a* interrupted at its center and around its periphery by the leg openings 36*a*. The base member further includes a peripheral flange 50 extending totally around the base member and coacting with the main body upper surface 38*a* to define a continuous seating surface extending around the periphery of the base within the flange 50 for receipt of the lower edge 26 of the sleeve 12. The seating surface includes grooves 52 defined over the tunnels or indentation 42–48 and is otherwise defined, adjacent the corners of the base member and adjacent the intermediate sections of the base member, by the upper surfaces of the bottom walls of the legs 36. Specifically, with the sleeve 12 seated on the base member, corner portions 26*a* and intermediate portions 26*b* of the lower edge of the sleeve are seated on the upper faces of the bottom walls of the legs 36 and the inset portions 26*c* of the lower edge of the sleeve are respectively seated in the grooves 52, over the tunnels or indentations 42–48, so as to position each slot 28 within a respective groove 52.

With the sleeve thus seated on the base member, the lower edge portions 26*a* and 26*b* of the sleeve are positioned substantially in the plane of the base member lower support surface 40*b* so that, in the case of a pallet constituting a ground supported pallet for the container the bottom edge of the sleeve terminates substantially at ground level. Thus, compressive forces applied downwardly to the container 10 are transferred by the sleeve 12 substantially to the floor or other supporting surface. As a result, deformation problems associated with the prior art designs are effectively eliminated without a substantial increase in manufacturing costs.

A plurality of latch members 56 are provided on base member 14 at circumferentially spaced locations thereabout. The latch members 56 correspond in number and circumferential position to the circular apertures 28 in sleeve 12 and are each positioned over an indentation or tunnel 42–48 and in association with a groove 52. Latch members 56 are mounted in the base member for sliding movement between a retracted position in which the sleeve lower edge is free to enter or leave grooves 52 and an extended or locking position in which the tips of the latch members are lockingly engaged with the sleeve 12 to lockably but releasably secure the sleeve to the base unit.

Latch members 56 are preferably formed of the same plastic material as the base member 14 and each include a main body portion 56*a*, in the form of an elongated plate of rectangular cross-section, and an annular handle or actuator portion 56*b* formed integrally with the main body portion 56*a* adjacent one end thereof. Latch members 56 are slidably positioned between the inner and outer skins 58 and 60 of the platform structure. Specifically, the inner and outer skins are configured to define slideways 62 with latch handle portion 56*b* extending downwardly into the space provided beneath the base member by the associated tunnel or indentation, and is mounted for sliding movement in a slot 66 provided in the lower skin of the base member to allow the inward and outward sliding movement of the latch members. Slots 66 desirably provide a detenting action for the latch members so as to provide a positive retracted or released position for the latch members and a positive extended or latching position for the latch members.

In accordance with the invention, a plurality of reinforcing clip structures 70 are provided for respective coaction with each of the circular apertures 28 and 30 so as to reinforce the apertures and preclude damage to the apertures and to the corrugated material of the sleeve surrounding the apertures over extended periods of usage of the apertures in coaction with the associated latch members.

Each reinforcing clip structure 70 is formed a single piece of plastic material, such for example as injection molded high density polyethylene. Each reinforcing clip structure 70 includes an outer annular planar portion 70*a*, an inner annular planar portions 70*b*, an outer cup-shaped liner portion 70*c*, an inner cup-shaped liner portion 70*d*, and a central hinge portion 70*e*.

Outer annular planar portion 70*a* defines a central circular opening 70*f* and is adapted to be positioned against an outer face 12*a* of the sleeve.

Inner annular planar portion 70*b* defines a central circular opening 70*g* and is adapted to be positioned against an inner face 12*b* of the sleeve.

Outer cup-shaped liner portion 70*c* is positioned within and projects inwardly from the outer planar portion and is sized to seat within an aperture 28. Liner portion 70*c* includes an annular, circular wall section 70*h* seated within and engaging an outer annular portion 28*a* of the aperture edge 28 and a planar circular base section 70*i* positioned centrally within the aperture.

Inner cup-shaped liner portion 70*d* is positioned within and projects outwardly from the inner planar portion 70*b* and is sized to seat within the aperture 28. Liner portion 70*d* includes an annular wall section 70*j* seated within and engaging an inner annular portion 28*b* of the aperture and a planar base section 70*k* positioned centrally within the aperture and abutting against the base section 70*i* of the outer liner portion.

The circular base section 70*k* of the inner liner portion includes a rectangular slot 701 sized to pass an outwardly sliding latch member 56, and the circular base section 70*i* of the outer liner portion is provided with a diecut flap 70*m*. Slot 701 has a rectangular size and configuration corresponding generally to the rectangular cross-sectional configuration of latch member 56. Flap 70*m* is defined by a semicircular diecut edge 70*n* corresponding generally to the circular configuration of opening 70*f*.

Central hinge portion 70*e* interconnects the inner and outer planar portions 70*a*/70*b* and is adapted to seat against a lower edge 26*c* of the sleeve.

Figure 5:
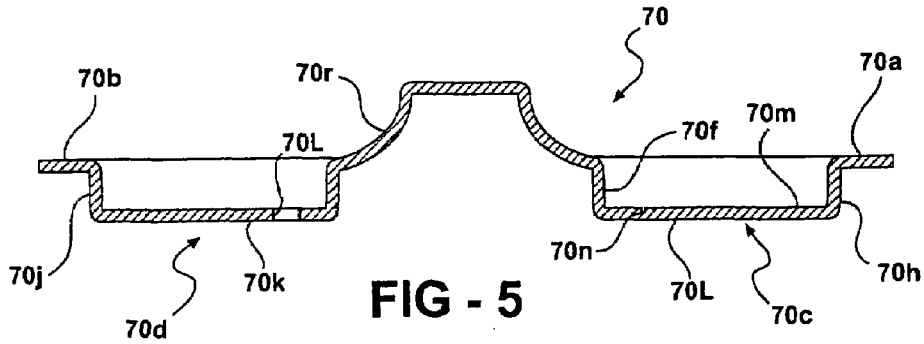
FIG. 5 is a cross-sectional view taken on line 5—5 of FIG. 4.
Figure 6:
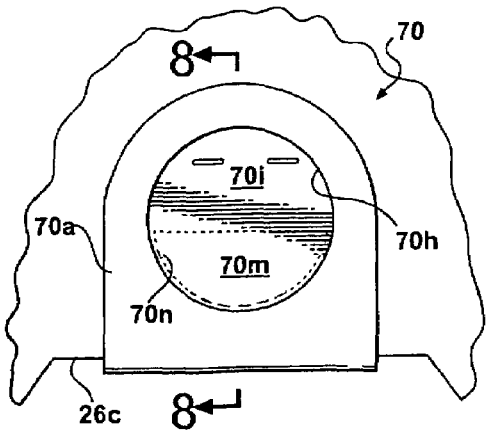
FIGS. 6 and 7 are detail views of the reinforcing clip structure of the invention shown in coaction with an aperture in the container sleeve.
Figure 7:
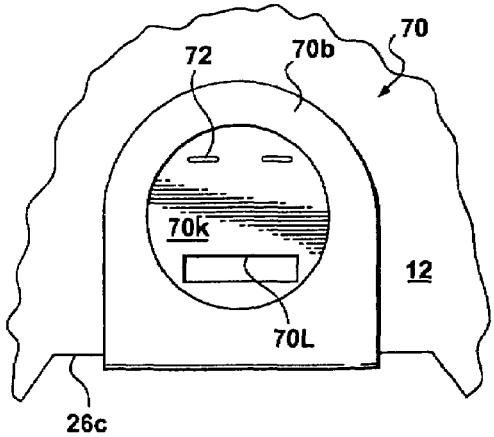
Figure 9:
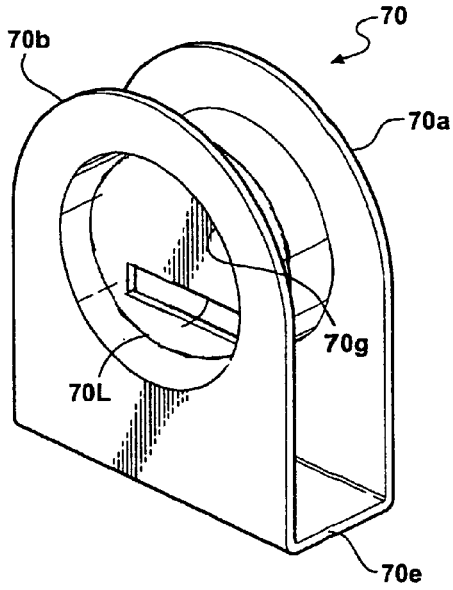
FIGS. 9 and 10 are perspective views of the reinforcing clip structure.
Figure 10:
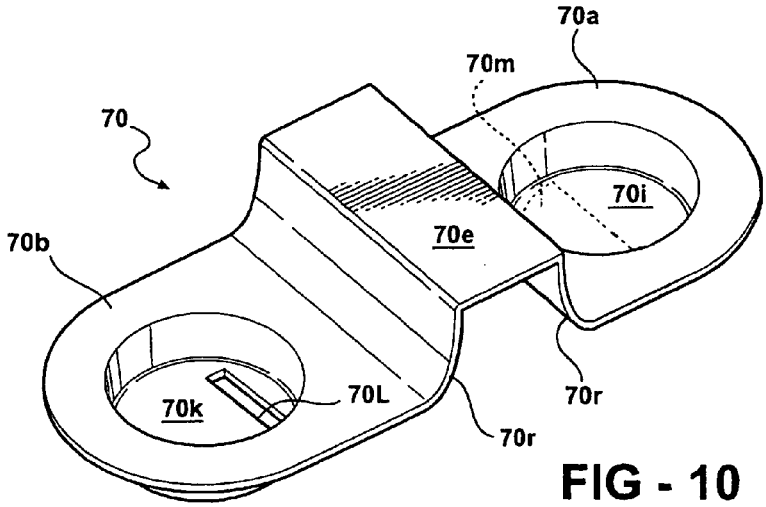

As molded, the clip has the generally planar configuration best seen in FIGS. 5 and 10 wherein the hinge portion 70*e* is interconnected to planar portions 70*a*/70*b* by arcuate live hinge portions 70*r* which enable the planar portions 70*a*/70*b* of the clip to be folded upwardly to define the U-shaped operational configuration best seen in FIG. 9.

In the use of the invention reinforcing clip to provide reinforcement for the apertures 28 in the corrugated sleeve, the central hinge portion 70*e* of the clip is positioned below and along an inset edge 26*c* below an aperture 28 whereafter the inner and outer planar portion 70*a*/70*b* are pivoted upwardly and inwardly about the hinge axes defined by the central hinge portion 70*e* so that the cup-shaped liner portions 70*c*/70*d* enter the aperture 28 respectively from the outside and the inside of the sleeve to position the circular annular wall sections 70*h*/70*j* within the aperture 28 and position the planar base portions 70*i*/70*k* centrally within the aperture in abutting relation whereafter the clip may be secured to the sleeve by suitable fastening means such as staples 72 passing through the abutting planar base section 70*i*/70*k* to firmly lock the base sections together and preclude inadvertent dislodgement of the clip from the aperture.

Figure 8:
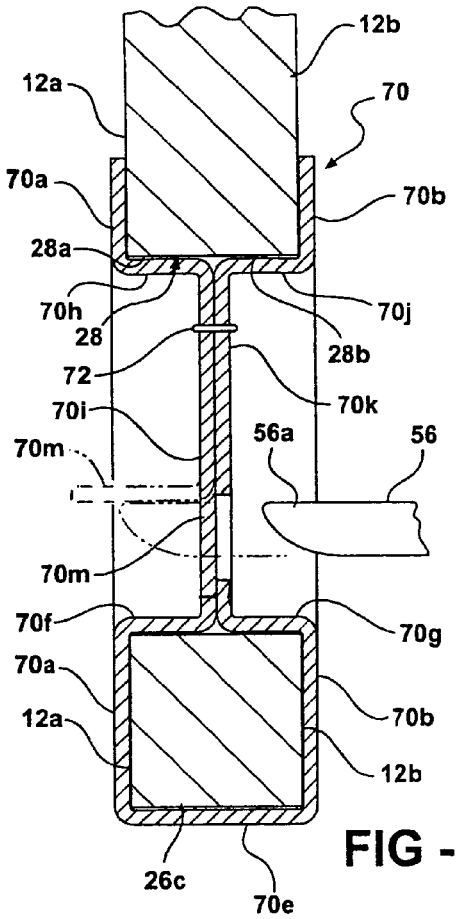
FIG. 8 is a cross-sectional view taken on line 8—8 of FIG. 6.

It will be understood that a clip 70 is utilized in association with each of the apertures 28 in the side walls of the sleeve. With the clips in place and with the sleeve positioned on the base member 48, latches 56 may be moved outwardly to releasably secure the sleeve to the pallet. As the latch members 56 move outwardly, the leading tapered end 56*a* of each latch passes through a respective slot 701 and, with continued outward movement of the latch member, the diecut flap 70*m* breaks out of the base section 70 and is pivoted upwardly and moves outwardly with the latch member into the latched configuration seen in FIG. 8.

In its mounted, locked position, the reinforcing clip provides a liner within the aperture 28 for receipt of a latch 56 so as to preclude damage to the aperture as the latch 56 moves into and out of the clip over repeated cycles of operation of the container. Specifically, planar portion 70*a* protects the area of the sleeve on the outside of the sleeve surrounding the aperture; planar portion 70*b* protects the area of the sleeve on the inside of the sleeve surrounding the aperture; and the annular wall sections 70*h*/70*j* protect the edge of the aperture. The circular configuration of the annular wall sections of the clip in coaction with the circular configuration of the aperture provides a large area interface between the clip and the sleeve to discourage tearing of the cardboard material of the sleeve even over extended periods of operation and even in the face of rough handling of the container and, particularly, forces applied to upper edges of the sleeve tending to tip the sleeve upwardly away from the base and tear out the cardboard material of the sleeve between the clip and the lower edge of the sleeve. The ability of the clip of the invention to withstand severe usage without damage to the sleeve is further enhanced by the fact that there are no corners or angularities at the interface of the clip and the sleeve so that there are no areas of stress concentration at the interface between the clip and the sleeve that would eventually generate sleeve failure. Although the invention has been described with particular reference to the attachment of the lower edge of the sleeve to a base member 14, it will be understood that clips 70 may also be utilized in association with apertures 30 adjacent the upper edge of the sleeve to facilitate the releasable securement of a top member (not shown) to the upper edge of the sleeve.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A reinforcing clip for use with a sleeve having at least one aperture defined by an annular aperture edge and positioned adjacent an edge of the sleeve, the reinforcing clip comprising:

an outer annular planar portion adapted to be positioned against an outer face of the sleeve adjacent the aperture;

an inner annular planar portion adapted to be positioned against an inner face of the sleeve adjacent the aperture;

a central hinge portion interconnecting the inner and outer planar portions and adapted to seat against the sleeve edge;

an outer cup shaped liner portion positioned within and projecting inwardly from the outer planar portion and sized to seat within the aperture with an annular wall section of the outer liner portion engaging an outer annular portion of the aperture edge and a planar base section of the liner portion, positioned centrally within the aperture; and an inner cup shaped liner portion positioned within and projecting outwardly from the inner planar portion having an outer diameter corresponding to the outer diameter of the annular wall section of the outer liner portion, and sized to seat within the aperture with an annular wall section of the inner liner portion, having a diameter corresponding to the diameter of the annular wall section of the outer liner portion, engaging an inner annular portion of the aperture and a planar base section of the inner liner portion, abutting against the base section of the outer liner portion, wherein the planar base sections of the inner and outer liner portions extend radially inwardly from their respective annular wall sections.

2. A reinforcing clip according to claim 1 wherein:

the aperture has an arcuate configuration; and the annular wall sections of the inner and outer liner portions are arcuately configured to match the arcuate configuration of the aperture.

3. A reinforcing clip according to claim 2 wherein:

the aperture has a circular configuration; and the annular wall sections of the inner and outer liner portions have a circular configuration matching the circular configuration of the aperture.

4. A reinforcing clip according to claim 3 wherein the base section of the inner liner portion has a slot for passage of a sliding latch carried by an associated container end unit mounting the sleeve.

5. A reinforcing clip according to claim 1 in combination with fastening means for maintaining the base sections of the inner and outer liner portions in abutting relation.

6. A reinforcing clip combination according to claim 5 wherein the fastening means comprises staples.

7. A sleeve assembly for use with an end unit to form a container, the sleeve assembly comprising:

a sleeve including an edge adapted to seat on the end unit and including a plurality of apertures each defined by an annular aperture edge and positioned adjacent the sleeve edge for locking receipt of a plurality of sliding latch members carried by the end unit; and a plurality of reinforcing clips for respective coaction with the apertures, each clip including an outer annular planar portion adapted to be positioned against an outer face of the sleeve adjacent the respective aperture, an inner annular planar portion adapted to be positioned against an inner face of the sleeve adjacent the respective aperture, a central hinge portion interconnecting the inner and outer planar portions and adapted to seat against the sleeve edge, an outer cup shaped liner portion positioned within and projecting inwardly from the outer planar portion and sized to seat within the respective aperture with an annular wall section of the outer liner portion engaging an outer annular portion of the aperture edge and a solid planar base section of the liner portion, having a size and shape corresponding to the cross-sectional configuration of the outer liner annular wall section and extending generally parallel to the inner and outer planar portions; positioned centrally within the aperture, and an inner cup-shaped liner portion positioned within and projecting outwardly from the inner planar portion and sized to seat within the aperture with an annular wall section of the inner liner portion, having a diameter corresponding to the diameter of the annular wall section of the outer liner portion, having an outer diameter corresponding to the outer diameter of the annular wall section of the outer liner portion, engaging an inner annular portion of the aperture and a solid planar base section of the inner liner portion, having a size and shape corresponding to the cross-sectional configuration of the inner liner annular wall section and extending generally parallel to the inner and outer planar portions, abutting against the base section of the inner liner portion, wherein the planar base sections of the inner and outer liner portions extend radially inwardly from their respective annular wall sections.

8. A sleeve assembly according to claim 7 wherein:

each aperture has an arcuate configuration; and the annular wall sections of the inner and outer liner portions of each clip are arcuately configured to match the arcuate configuration of the respective aperture.

9. A sleeve assembly according to claim 8 wherein:

each aperture has a circular configuration; and the annular wall sections of the inner and outer liner portions of each clip have a circular configuration matching the circular configuration of the respective aperture.

10. A sleeve assembly according to claim 9 wherein:

the base section of the inner liner portion of each clip has a slot for passage of a sliding latch member carried by the end unit.

11. A sleeve assembly according to claim 7 wherein each clip further includes fastening means for maintaining the base sections of the inner and outer liner portions in abutting relation.

12. A sleeve assembly according to claim 11 wherein the fastening means comprise staples.

13. A container comprising:

an end unit assembly including an end unit and a plurality of sliding latch members mounted on the end unit at circumferentially spaced locations around the periphery thereof;

a sleeve including an edge seating on the end unit and including a plurality of apertures each defined by an annular aperture edge and positioned adjacent the sleeve edge for locking receipt of the latch members; and a plurality of reinforcing clips for respective coaction with the apertures, each clip including an outer annular planar portion adapted to be positioned against an outer face of the sleeve adjacent the respective aperture, an inner annular planar portion adapted to be positioned against an inner face of the sleeve adjacent the respective aperture, a central hinge portion interconnecting the inner and outer planar portions and adapted to seat against the sleeve edge, an outer cup-shaped liner portion positioned within and projecting inwardly from the outer planar portion and sized to seat within the respective aperture with an annular wall section of the outer liner portion engaging an outer annular portion of the aperture edge and a solid planar base section of the liner portion, having a size and shape corresponding to the cross-sectional configuration of the outer liner annular wall section and extending generally parallel to the inner and outer planar portions positioned centrally within the aperture, and an inner cup-shaped liner portion positioned within and projecting outwardly from the inner planar portion and sized to seat within the respective aperture with an annular wall section of the inner liner portion, having a diameter corresponding to the diameter of the annular wall section of the outer liner portion engaging an inner annular portion of the aperture edge and a planar base section of the inner liner portion, having a size and shape corresponding to the cross-sectional configuration of the inner liner annular wall section and extending generally parallel to the inner and outer planar portions abutting against the base section of the inner liner portion, wherein the planar base sections of the inner and outer liner portions extend radially inwardly from their respective annular wall sections.

14. A container according to claim 13 wherein:

each aperture has an arcuate configuration; and the annular wall sections of the inner and outer liner portions of each clip are configured to match the arcuate configuration of the respective aperture.

15. A container according to claim 14 wherein:

each aperture has a circular configuration; and the annular wall sections of the inner and outer liner portions of each clip have a circular configuration matching the circular configuration of the respective aperture.

16. A container according to claim 15 wherein the base section of the inner liner portion of each clip has a slot for passage of a sliding latch member carried by the end unit.

17. A container according to claim 13 wherein each clip further includes fastening means for maintaining the base sections of the inner and outer liner portions in abutting relation.

18. A container according to claim 17 wherein the fastening means comprises staples.

19. A reinforcing clip for use with a sleeve having at least one aperture defined by an annular aperture edge and positioned adjacent an edge of the sleeve, the reinforcing clip comprising:

an outer annular planar portion adapted to be positioned against an outer face of the sleeve adjacent the aperture;

an inner annular planar portion adapted to be positioned against an inner face of the sleeve adjacent the aperture;

a central hinge portion interconnecting the inner and outer planar portions and adapted to seat against the sleeve edge;

an outer cup shaped liner portion positioned within and projecting inwardly from the outer planar portion and sized to seat within the aperture with an annular wall section of the outer liner portion engaging an outer annular portion of the aperture edge and a planar base section of the liner portion positioned centrally within the aperture; and an inner cup shaped liner portion positioned within and projecting outwardly from the inner planar portion and sized to seat within the aperture with an annular wall section of the inner liner portion engaging an inner annular portion of the aperture and a planar base section of the inner liner portion abutting against the base section of the outer liner portion;

the aperture having a circular configuration;

the annular wall sections of the inner and outer liner portions having a circular configuration matching the circular configuration of the aperture;

the base section of the inner liner portion having a slot for passage of a sliding latch carried by and associated container end unit mounting the sleeve;

the base section of the outer liner portion including a flap covering the slot in the base section of the inner liner portion and sized to be pivoted outwardly in response to outward sliding movement of the latch.

20. A reinforcing clip for use with a sleeve having at least one aperture defined by an arcuate aperture edge and positioned adjacent the edge of the sleeve, the reinforcing clip comprising:

an outer annular planar portion adapted to be positioned against an outer face of the sleeve adjacent the aperture;

an inner annular planar portion adapted to be positioned against an inner face of the sleeve adjacent the aperture;

a central hinge portion interconnecting the inner and outer planar portions and adapted to seat against the edge of the sleeve;

an outer liner portion positioned within and projecting inwardly from the outer planar portion and sized to seat within the aperture with an arcuate annular wall section of the outer liner portion engaging an outer annular portion of the arcuate aperture edge; and an inner liner portion positioned within and projecting outwardly from the inner planar portion and sized to seat within the aperture with an arcuate annular wall section of the inner liner portion engaging an inner annular portion of the arcuate aperture;

the aperture having a circular configuration;

the annular wall sections of the inner and outer liner portions having a circular configuration matching the circular configuration of the aperture;

each liner portion having a cup shaped configuration and including a planar base section within the arcuate annular wall section;

the planar base sections of the liner portions abutting with the clip positioned in the aperture;

the base section of the inner liner portion having a slot for passage of a sliding latch carried by an associated container end unit mounting the sleeve;

the base section of the outer liner portion including a flap covering a slot in the base section of the inner liner portion and sized to be pivoted outwardly in response to outward sliding movement of the latch.

21. A sleeve assembly for use with an end unit to form a container, the sleeve assembly comprising:

a sleeve including an edge adapted to seat on the end unit and including a plurality of apertures each defined by an annular aperture edge and positioned adjacent the sleeve edge for locking receipt of a plurality of sliding latch members carried by the end unit; and a plurality of reinforcing clips for respective coaction with the apertures, each clip including an outer annular planar portion adapted to be positioned against an outer face of the sleeve adjacent the respective aperture, an inner annular planar portion adapted to be positioned against an inner face of the sleeve adjacent the respective aperture, a central hinge portion interconnecting the inner and outer planar portions and adapted to seat against the sleeve edge, an outer cup shaped liner portion positioned within and projecting inwardly from the outer planar portion and sized to seat within the respective aperture with an annular wall section of the outer liner portion engaging an outer annular portion of the aperture edge and a base section of the liner portion positioned centrally within the aperture, and an inner cup-shaped liner portion positioned within and projecting outwardly from the inner planar portion and sized to seat within the aperture with an annular wall section of the inner liner portion engaging an inner annular portion of the aperture and a base section of the inner liner portion abutting against the base section of the inner liner portion;

each aperture having a circular configuration;

the annular wall sections of the inner and outer liner portions of each clip having a circular configuration matching the circular configuration of the respective apertures;

the base section of the inner liner portion of each clip having a slot for passage of a sliding latch member carried by the end unit;

the base section of the outer liner portion of each clip including a flap covering the slot in the base section of the inner liner portion and sized to be pivoted outwardly in response to outward sliding movement of the latch member.

22. A container comprising:

an end unit assembly including an end unit and a plurality of sliding latch members mounted on the end unit at circumferentially locations around the periphery thereof;

a sleeve including an edge seating on the end unit and including a plurality of apertures each defined by an annular aperture edge and positioned adjacent the sleeve edge for locking receipt of the latch members; and a plurality of reinforcing clips for respective coaction with the apertures, each clip including an outer annular planar portion adapted to be positioned against an outer face of the sleeve adjacent the respective aperture, an inner annular planar portion adapted to be positioned against an inner face of the sleeve adjacent the respective aperture, a central hinge portion interconnecting the inner and outer planar portions and adapted to seat against the sleeve edge, an outer cup-shaped liner portion positioned within and projecting inwardly from the outer planar portion and sized to seat within the respective aperture with an annular wall section of the outer liner portion engaging an outer annular portion of the aperture edge and a base section of the liner portion position centrally within the aperture, and an inner cup-shaped liner portion positioned within and projecting outwardly from the inner planar portion and sized to seat within the respective aperture with an annular wall section of the inner liner portion engaging an inner annular portion of the aperture edge and a base section of the inner liner portion abutting against the base section of the inner liner portion;

each aperture having a circular configuration;

the annular wall sections of the inner and outer liner portions of each clip having a circular configuration matching the circular configuration of the respective aperture;

the base section of the inner liner portion of each clip having a slot for passage of a sliding latch member carried by the end unit;

the base section of the outer liner portion of each clip including a flap covering a slot in the base section of the inner liner portion and sized to be pivoted outwardly in response to outward sliding movement of the latch member.

* * * * *